US006820874B2

(12) United States Patent
Blaser et al.

(10) Patent No.: US 6,820,874 B2
(45) Date of Patent: Nov. 23, 2004

(54) DEVICE FOR PROCESSING BANK NOTE-LIKE OBJECTS

(75) Inventors: Hans Blaser, Burgdorf (CH); Armin Zöbeli, Steffisburg (CH)

(73) Assignee: Beb Industrie-Elektronik AG, Oberburg (CH)

( * ) Notice: Subject to any disclaimer, the term of this patent is extended or adjusted under 35 U.S.C. 154(b) by 0 days.

(21) Appl. No.: 10/444,825

(22) Filed: May 23, 2003

(65) Prior Publication Data

US 2003/0192766 A1 Oct. 16, 2003

Related U.S. Application Data

(62) Division of application No. 09/600,927, filed as application No. PCT/CH99/00001 on Jan. 5, 1999, now Pat. No. 6,578,695.

(30) Foreign Application Priority Data

Jan. 23, 1998 (EP) ..... 98101110

(51) Int. Cl.[7] ..... B65H 5/06
(52) U.S. Cl. ..... 271/274
(58) Field of Search ..... 198/570, 624, 198/626.4, 626.6; 271/264, 273, 274, 275, 314

(56) References Cited

U.S. PATENT DOCUMENTS

| | | | | | |
|---|---|---|---|---|---|
| 4,825,917 | A | * | 5/1989 | Gonner | 144/4.9 |
| 4,922,109 | A | | 5/1990 | Bercovitz et al. | |
| 5,499,810 | A | * | 3/1996 | Tranquilla | 271/274 |
| 5,622,249 | A | * | 4/1997 | Morin | 198/499 |
| 5,624,017 | A | | 4/1997 | Plesko | |
| 5,645,275 | A | * | 7/1997 | Tranquilla | 271/274 |
| 5,653,438 | A | | 8/1997 | Crowley et al. | |
| 5,727,782 | A | * | 3/1998 | Okada | 271/121 |
| 5,918,876 | A | * | 7/1999 | Maruyama et al. | 271/228 |
| 6,283,353 | B1 | * | 9/2001 | Gilbert | 226/190 |
| 6,325,370 | B1 | | 12/2001 | Crotti et al. | |
| 2001/0015309 | A1 | | 8/2001 | Yoshiaki | |

FOREIGN PATENT DOCUMENTS

| | | | | |
|---|---|---|---|---|
| DE | 27 29 830 | | 1/1979 | |
| DE | 27 60 165 | C2 | 1/1979 | |
| EP | 606 959 | A2 | 7/1994 | |
| GB | 2 058 607 | A | 4/1981 | |
| JP | 5-58528 | A * | 3/1993 | B65H/29/22 |

* cited by examiner

*Primary Examiner*—Donald P. Walsh
*Assistant Examiner*—Mark J Beauchaine
(74) *Attorney, Agent, or Firm*—Rankin, Hill, Porter & Clark, LLP

(57) ABSTRACT

The device for the processing of bank notes has a modular design. It has at least one inlet (311) and at least one outlet (361.1, 361.2). The device contains a fixed part (1) and interchangeable mobile modules (31–36) each for performing a complete processing function upon the bank note-like objects. The modules (31–36) are pluggable into pins (2.1, 2.2, . . . ) attached to the fixed part (1), so that they are easily insertable, removable or interchangeable. The modules (31–36) are selectable from a set of different modules and are combinable in almost any possible manner, providing a multitude of freely selectable processing sequences. A contact pressure unit may be included within a module transport unit, the contact pressure unit including at least one contact element, at least one reversibly compressible and damping element and at lest one pressure roller wherein forces are produced by the compressible and damping element and act of the pressure roller in the direction of the contact element.

13 Claims, 10 Drawing Sheets

Fig. 6
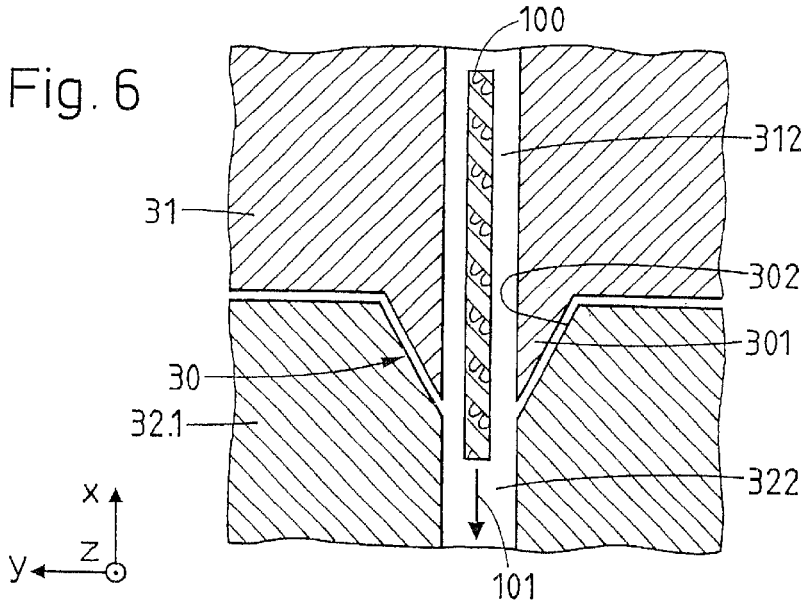
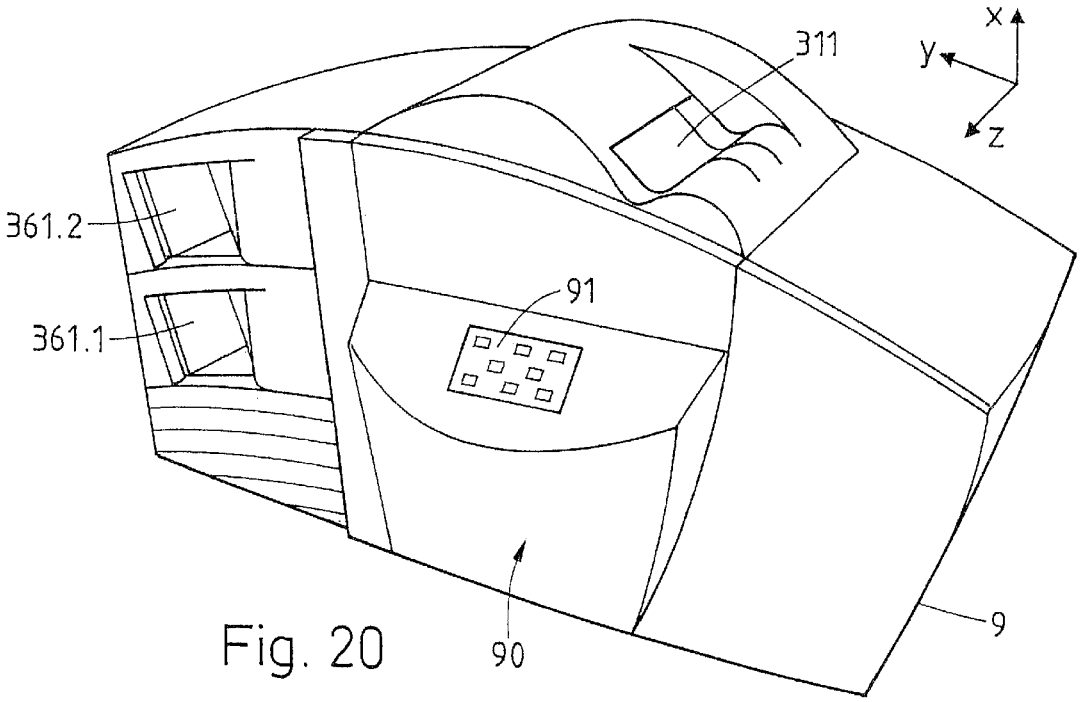
Fig. 20

DEVICE FOR PROCESSING BANK NOTE-LIKE OBJECTS

BACKGROUND OF THE INVENTION

The invention relates to a device that is suitable for reading, identifying, checking, verifying, examining, counting, sorting and/or stacking bank notes and/or bank note-like objects. Such "bank note-like objects" include bank notes, cheques, share certificates, documents with a security imprint, certificates, admission tickets or travel tickets, vouchers, credit cards, bank cards, identification cards, and access cards. The invention also relates to a contact pressure unit, a transport unit, a position sensor and a feeder device for processing bank note-like objects.

Devices for processing bank note-like objects are known. Such devices carry out processing functions such as feeding, separation, transporting, deflecting, rotating, reading, sorting or stacking on the bank note-like objects. For this purpose, the processing devices are equipped with complex mechanical, electronic and/or optical components. These components, during installation, have to be brought into the correct position relative to one another, in order to carry out a desired processing sequence faultlessly and without interruption. The device is usually conceived designed for a certain processing sequence; if other processing functions are to be carried out, a new, different device has to be conceived and designed or else at least the existing device modified at great expense. Apart from this, most components require an electric power supply, which usually is implemented with the help of expensive, complicated wiring inside the device. Such wiring makes the manufacture and the maintenance of the device more difficult, is confusing and susceptible to defects.

The bank note-like objects to be processed frequently transfer dirt, ink and/or dust to the device. As a result, the operability of individual components or of the whole device (e.g., through jamming of the bank note-like objects) can be seriously impaired. In order to, in such a case, repair known devices for the processing of bank note-like objects, the devices have to be dismantled, the jammed objects removed, cleaned and re-assembled again, which requires a lot of time and effort.

In summary, the manufacture and maintenance of known devices for the processing of bank notes is usually associated with a relatively great effort and expense, which in turn leads to high manufacturing and operating costs.

Apart from this, known devices for the processing of bank notes are frequently equipped with unsuitably complicated and expensive contact pressure and/or transport units with position sensors susceptible to contamination with dirt and with unreliable feeder units that deform the bank note-like objects.

SUMMARY OF THE INVENTION

It is an object of the invention to create a device for processing bank note-like objects, which avoids the above-mentioned disadvantages and which, in particular, has a clear design layout, can be easily and rapidly assembled and maintained and which is able to carry out a multitude of different processing sequences. It is also an object of the invention to create a simple, cost-effective contact pressure unit for the pressing of bank note-like objects against another element. It is furthermore an object of the invention to create a simple, cost-effective and defect-free transport unit for the transporting of bank note-like objects. Apart from this, it is an object of the invention to create a robust position sensor not susceptible to contamination with dirt for determining whether a bank note-like object at a certain time is in a certain position. Furthermore, it is an object of the invention to create a feeder unit for drawing-in individual bank note-like objects, in which the bank note-like objects are not deformed and which guarantees individualised processing of the bank note-like objects.

These objects are achieved by the device according to the present invention, the contact pressure unit in accordance with the invention, the transport unit in accordance with the invention, the position sensor in accordance with the invention, and the feeder unit in accordance with the invention.

Understood by the term "bank note-like objects" in this document are sheet-like, thin and usually bendable object with graphic printing, which represent a certain material value and, therefore, include bank notes in the actual sense and also other such objects. Examples of bank note-like objects are bank notes, bank cheques, share certificates, documents with a security imprint, certificates, admission tickets or travel tickets, vouchers, credit and/or bank cards, identity and/or access cards. When in this document "processing functions" are referred to, then the meaning is functions such as feeding, separating, individualising, transporting, reading, identifying, checking, verifying, examining, counting, sorting and/or stacking, which are carried out on the bank note-like objects. A "processing sequence" is composed of several such functions.

The invention is based on the idea of designing a device for processing bank note-like objects in a modular way. The different completed processing functions are carried out by independent modules. Such modules are interchangeable mobile components, which can be utilised in a fixed part of the device such that a desired operating sequence for the processing of bank note-like objects is implementable. The modules have standardised interfaces, at which the bank note-like objects are transferred from one module to the next. The device has to be designed such that the interfaces are positioned correctly relative to one another and such that transfers of bank note-like objects are possible when modules are installed in the device. The modules are selectable from a set of different modules and can be combined in almost any manner, so that with this a multitude of freely selectable processing sequences can be implemented.

The modules can easily be inserted into the device in accordance with the invention, for example, by plugging in or hooking on and can be equally easily removed and interchanged. Such a modular design therefore assures an exceedingly simple assembly and maintenance of the device. It also makes possible a rapid and easy changing of the desired processing sequence in that modules are easily added, removed, moved and/or exchanged. The device in accordance with the invention is expandable or extendable according to the requirements of the user. The individual modules are robust, because they contain only a necessary minimum of delicate electric, electronic and/or optical elements that are susceptible to contamination with dirt. If possible, such delicate elements are located outside the modules, so that the communication between the modules and the rest of the device is limited to mechanical signals. The maintenance of the device is simple and quick, because as a result of the modularity a jam can easily be rectified and individual modules are easily cleaned. The modularity, however, produces benefits not only for the user, but also for the manufacturer. For example, redesigning the device in accordance with the invention is significantly simpler, because only certain components have to be modified, while others can be taken over from existing devices.

The device in accordance with the invention for the processing of bank note-like objects is preferably operated electrically and has at least one inlet as well as at least one outlet for the bank note-like objects. The device comprises a fixed part and interchangeable mobile components, whereby the mobile components are for carrying-out of respectively one complete processing function on the bank note-like objects to be processed. These modules can be installed in the fixed part such that between the at least one inlet and the at least one outlet a desired operating sequence for processing bank note-like objects can be implemented.

The fixed part of the device in accordance with the invention is preferably designed as a rigid supporting structure, for example, as a wall of the plate forming the device, a profile or as a grating of bars. The device preferably has mechanical means of connection, by means of which the modules can be fixed to the fixed part through a positive releasable mechanical connection. The modules, for example, can be plugged into or hooked onto the fixed part.

On the fixed part of the device in accordance with the invention drive means such as electric motors can be attached. In the mobile parts active means can be attached, which mechanically act on the bank note-like objects. Such means may be, for example, rollers for the transportation of the bank note-like objects. By means of transmission means, such as toothed (synchronous) belts, perforated wheels or perforated wheel rims, drawbars, levers, clutches, mechanical switches or shafts, forces and/or torques are transmittable to the active means from the drive means. It is advantageous not to incorporate the drive means in the mobile parts, but rather in the fixed part of the device. In this manner, one achieves a clear, consistent separation of the drive means and mobile parts. The separation has the advantage that the electric lines and components are attached to the fixed part in a clear layout, like on a printed circuit board of an electronic device, and can be more easily installed and maintained. Most mobile parts contain only mechanical components.

BRIEF DESCRIPTION OF THE DRAWINGS

These and further features of the invention will be apparent with reference to the following description and drawings, wherein.

DETAILED DESCRIPTION OF THE PREFERRED EMBODIMENTS

Figure 1:
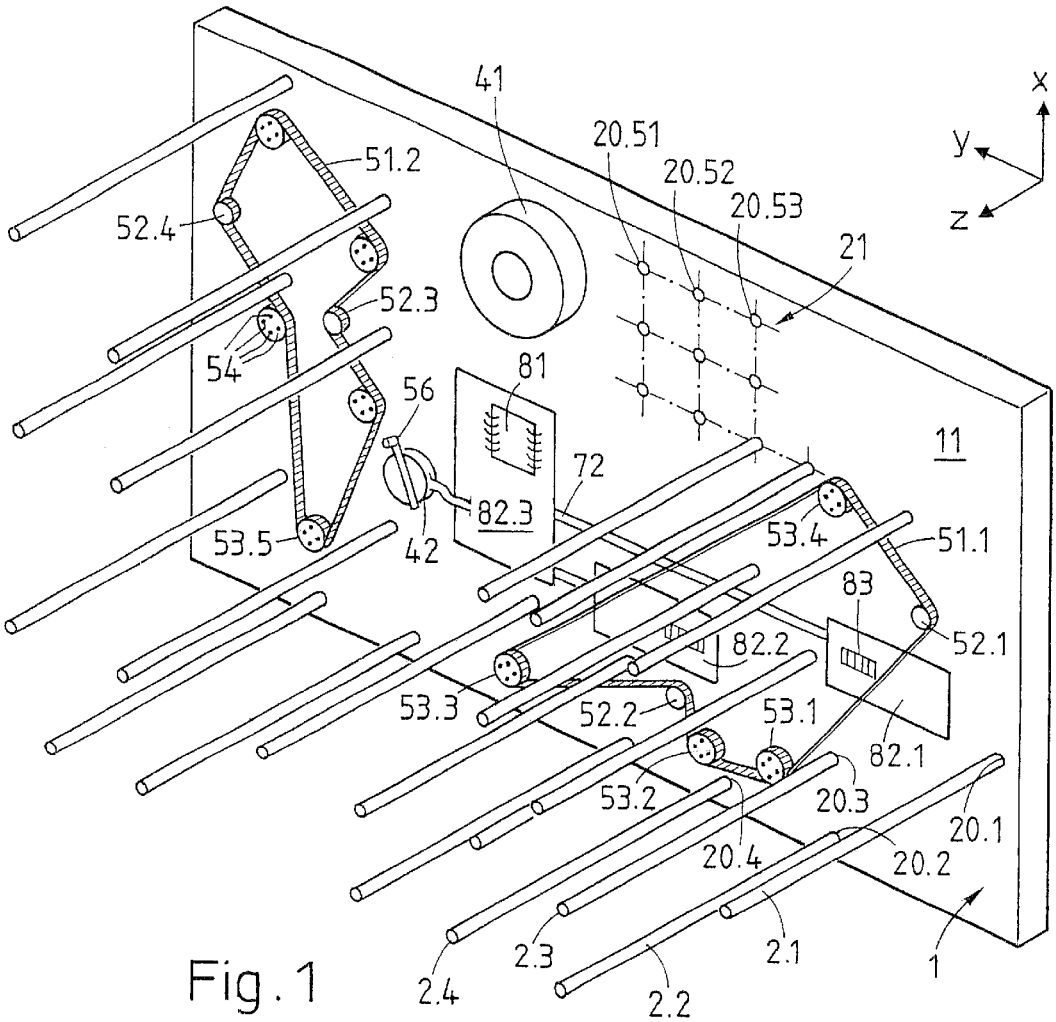
FIG. 1 a perspective view from the front of the fixed part of the device in accordance with the invention, FIG. 2 a perspective view from the back of the fixed part of the device in accordance with the invention of FIG. 1, FIG. 3 a perspective view from the front of the partially opened device in accordance with the invention, FIGS. 4 and 5 front views of details of the fixing means of modules in the device in accordance with the invention, FIG. 6 a cross section through an interface between two modules of the device in accordance with the invention, FIGS. 7–12 different modules for the utilization of the device in accordance with the invention, FIGS. 13–14 a longitudinal view and a cross sectional view, respectively, through a transport unit in accordance with the invention, FIGS. 15–16 longitudinal sections through a position sensor in accordance with the invention, FIG. 17 a perspective view of the position sensor of 15 and 16, FIGS. 18–19 a longitudinal view and a cross sectional view, respectively, through a feeder unit and FIG. 20 a perspective view of a device in accordance with the invention.

The device in accordance with the invention contains a fixed part and interchangeable mobile parts. FIG. 1 illustrates a perspective view of the fixed part 1 of the device. The fixed part 1 is preferably designed as an essentially rigid supporting structure, for example, as a plate, which simultaneously serves as the back wall of the device. For better orientation, in the Figures Cartesian co-ordinates (x, y, z) are included, whereby the plate 1 always defines the x-y plane. On the plate 1, at the fixing points 20.1, 20.2, . . . pins 2.1, 2.2, . . . are attached. The pins, in essence, vertically protrude from a first side 11 of the plate 1, therefore in z-direction. These pins 2.1, 2.2, . . . are used for plugging-in interchangeable modules (not shown in FIG. 1). On a first side 11 of the plate 1 other attachment points 20.51, 20.52, . . . for pins are foreseeable. Preferably, these other attachment points 20.51, 20.52 . . . are arranged in a grid 21, which is indicated in broken lines. The attachment of the pins 2.1, 2.2, . . . is effected with known means of attachment, such as, for example, screws.

On a first side 11 of the plate 1 elements are attached, which are necessary for the operation of the device. Such elements can be drive means 41, 42, transmission means 51–56, electric lines, electric and/or electronic components. Drive means 41, 42 produce forces and/or torques for the mechanical processing functions performed by the modules. For the processing function transportation, a single electric motor 41 is preferably present as a drive means. For the processing function sorting, at least one electromagnetic switch 42 is present as a second drive means. Means of transmission 51-56 transmit forces and/or torques from the drive means 40, 41 into the modules and/or vice-versa. By the motor 41 toothed (synchronous) belts 51.1, 51.2 are driven as first means of transmission. The toothed (synchronous) belts 51.1, 51.2 run on deflection rollers 52.1–52.4 and move perforated wheels, resp., perforated wheel rims 53.1, 53.2, . . . , which are preferably equipped with tapered bores 54. The bores 54 receive correspondingly formed pins 55.1, 55,2, . . . (illustrated in FIGS. 7–12), which are attached to the modules movably or rotatably. The tapered shape renders the relative positioning when inserting a module more easy. By the electromagnetic switch 42, a lever 56 is driven as a further means of transmission. Means of transmission can be (not illustrated) drawbars, clutches, mechanical switches, shafts, pinions, gears, chains, etc. In the device in accordance with the invention it is attempted if at all possible to only transmit mechanical signals from the plate 1 to the modules; this ensures a high robustness of the device.

A first type of electric lines 71 (FIG. 2) serves for the supply of electric power to the components, a second type of electric line 72 (FIG. 1) for the transmission of information between certain components; the two types of lines 71, 72 can also coincide. For example, the switch 42 of the sorting module needs information from the reading modules in order to decide which stack a certain bank note is to be brought to. The information processing, for example the processing of data from and to the user, the identification or examination of bank notes, the calculation of run times, control of switches, etc., takes place in at least one electronic component, for example, a micro-processor 81. For the reasons outlined further above, it is advantageous if at all possible to avoid the use of electric cables. For this purpose, on the first side of the plate preferably printed circuit boards 82.1–82.3 with sockets 83 are attached, into which corresponding plugs fixed to certain modules (not illustrated) can be plugged.

Figure 2:
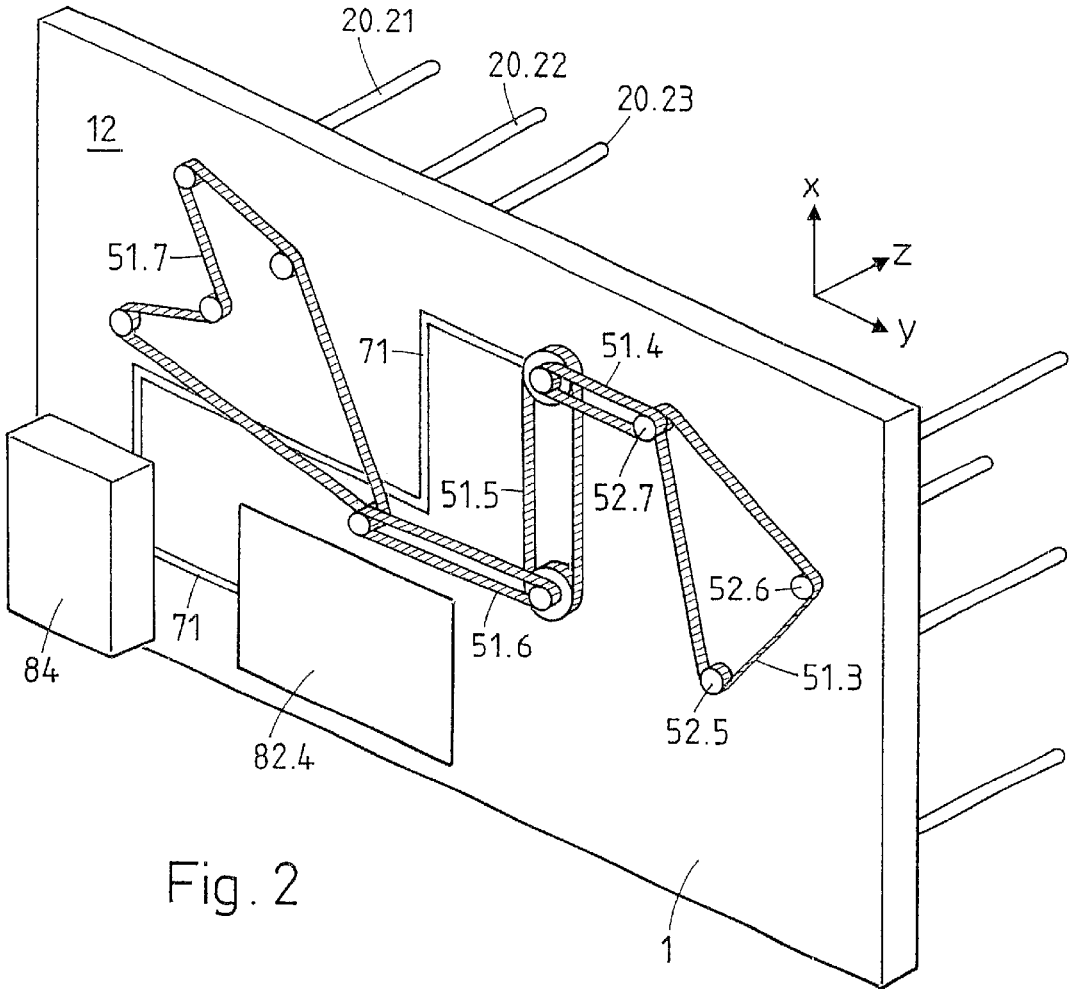

FIG. 2 shows a perspective view of the partially opened device of FIG. 1, but from the opposite or backside. On a second side 12 of the plate 1 further elements are attached which are necessary for the operation of the device. These can be means of transmission such as toothed (synchronous) belts 51.3–51.7 on deflection rollers 52.5, 52.6, . . . . These can also be electric components, e.g., a power supply unit 84, which supplies the voltage required by other elements, and/or a further printed circuit board 82.4. It is advantageous, if as many elements as possible are attached to the second side 12 of the plate 1. This is because it is more easily accessible so that during maintenance work not even modules have to be removed from their places.

Figure 3:
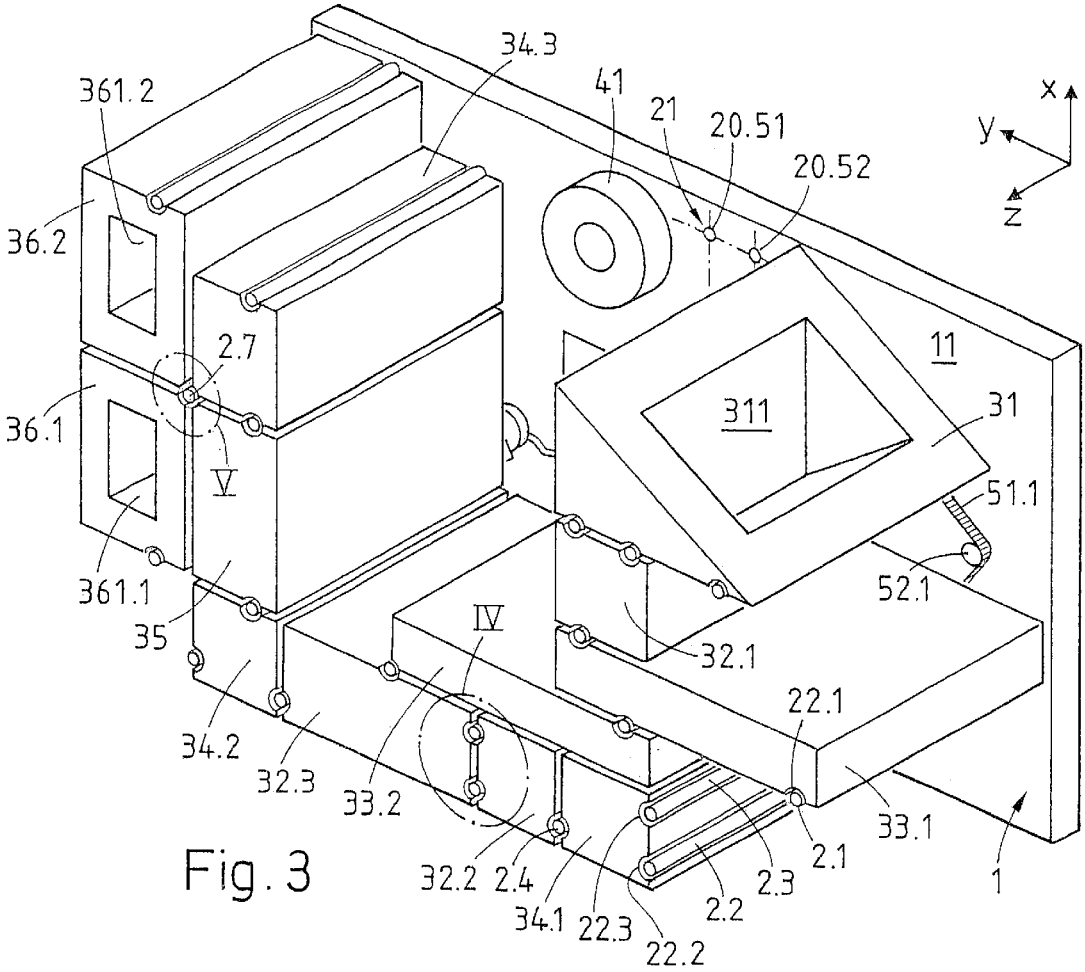

FIG. 3 in the same perspective view as FIG. 1 illustrates the plate 1 with inserted modules 31–36. The modules 31–36 are interchangeable mobile parts, which can be inserted into the fixed part 1 of the device such that a desired operating sequence for the processing of the bank note-like objects (not shown on FIG. 3) can be carried out. In the example of FIG. 3, the desired operating sequence is as follows: the bank note-like objects, for example, different bank notes, initially are present in the form of a stack (not illustrated) in an inlet compartment 311 of an inlet and separating module 31. The bank note-like objects are drawn into the device and separated from one another, read, deflected and transported, deflected once again, sorted and issued stacked.

This processing sequence is composed of a sequence of completed processing functions, which respectively are carried out by one module 31–36. Corresponding modules 31–36 are schematically illustrated in FIG. 3: an inlet and separating module 31 with an inlet compartment 311, which serves as entrance of the device, a first transport module 32.1, a first reading module 33.1, a second reading module 33.2, a first deflection module 34.1, a second transport module 32.2 and a third transport module 32.3, a second deflection module 34.2, a sorting module 35, a first stacking module 36.1 with an outlet compartment 361.1 and a second stacking module 36.2 with an outlet compartment 361.2. The outlet compartments 361.1, 361.2 serve as exits from the device. A single reading module is sufficient, if only one side of the bank notes has to be read; this can be the case, if the bank notes only have to be identified, for example, for the purpose of subsequent sorting in the sorting module 35. Two reading modules 33.1, 33.2 are necessary, if both sides of the bank notes have to be read. This is necessary, for example, if the bank notes have to be verified, i.e., examined. It is applicable in general that several reading modules 33.1, 33.2 increase the redundancy and with this the faultless operation and the security of the processing sequence.

Protruding from the plate 1 are pins 2.1, 2.2, . . . , onto which the modules 31–36 can be plugged. For this purpose, the modules 31–36 are equipped with mouldings (grooves/contours) and/or apertures 22.1, 22.2, . . . , into which the pins 2.1, 2.2, . . . are inserted. Such a plugging-in results in a simply, releasable, but nonetheless stable mechanical connection between the plate 1 and the modules 31–36. The plate 1 in preference has a standardized or uniform grid 21 of attachment points 20.51, 20.52, . . . for further pins. If so required, further pins can also be attached to the plate 1 and, vice-versa, others can be removed from the plate 1. The distances between the mouldings and/or apertures 22.1, 22.2, . . . in the modules 31–36 correspond to the spacing, preferably a standardized grid spacing, of the attachment points for pins 2.1, 2.2, . . . . The modules 31–36 therefore can be arranged on the plate 1 in a modular system with a great degree of freedom. For modules that require electric power such as, for example, a reading module 33.1, 33.2, corresponding (outlined in FIG. 1) electrical means of connection 83, for example sockets, are provided on the plate 1, on printed circuit boards 82.1–82.3 or on other elements fixed to the plate 1.

Figure 4:
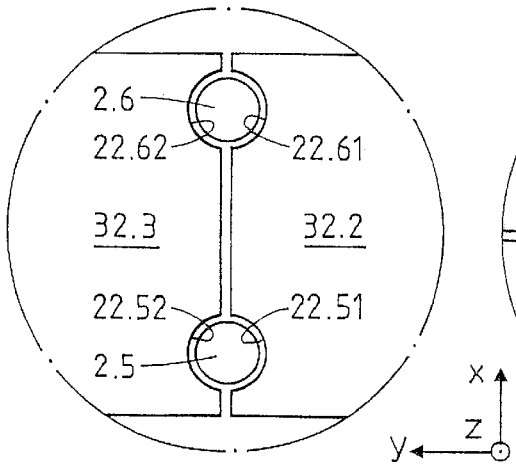

In FIG. 4 a frontal view of a detail IV of FIG. 3 is depicted. This shows the attachment, resp., hooking on of two modules, for example, of the second transport module 32.2 and of the third transport module 32.3. The two modules 32.2, 32.3 are plugged into two pins 2.5, 2.6 (as well as into other pins, which are not visible in FIG. 4), in that the pins 2.5, 2.6 are slid into mouldings 22.51, 22.52, 22.61, 22.62. Each one of the two pins 2.5, 2.6 connects both modules 32.2, 32.3 with the plate 1. Vice-versa, for the stable attachment of a module normally two, sometimes also more than two pins are required.

Figure 5:
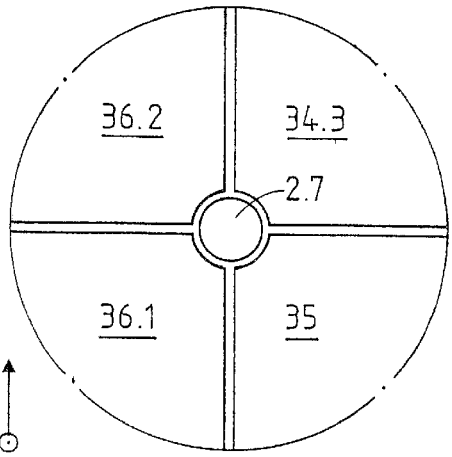

FIG. 5 shows, in the same view as FIG. 4, a detail V of the FIG. 3. Here one of the pins 2.7 connects the four modules 36.1, 36.2, 34.3, 35 with the plate 1. Such an arrangement in a certain sense is even more advantageous than that of FIG. 4, because with it fewer pins are necessary for the attachment of the modules.

The modules have standardized interfaces, at which the bank notes are transferred from one module to another. An exemplary embodiment of such an interface 30, say between the inlet and separating module 31 and the first transport module 32.1 of the device of FIG. 3, is illustrated in cross section in FIG. 6. A bank note 100 is transported in the first transport module 32.1 through a first slot 312 in the inlet and separating module 31 and through a second slot 322 adjoining it. The direction of travel of the bank note 100 is indicated with an arrow 101. The two slots 312, 322 communicate through the interface 30. At the interface 30, the inlet and separating module 31 has a wedge-shaped, elongated ridge 301. The first transport module 32.1 at the corresponding place is equipped with an elongated groove 302 for accommodating the ridge 301. The inter-meshing of ridge 301 and groove 302 provides an additional positioning aid for the two modules 31, 32.1 and ensures an impeccable transfer of the bank notes 100 from one module 31 into the other module 32.1 at the interface 30. The device is conceived and built such that the interfaces 30 are correctly positioned relative to one another and such that transfers of bank notes are possible when the modules 31–36 are inserted into the device.

The FIGS. 7-12 illustrate examples of different modules 31–36 that can be inserted into the device in accordance with the invention. In doing so, a movement of the (not depicted in FIG. 7–12) bank note-like objects, for example bank notes 100, is schematically indicated with arrows 102. The bank notes 100 typically move through the device with a speed of 600 to 1500 mm/sec; in doing so, the space between them amounts to approx. 20 to 50 mm. With these values, a typical flow rate of four to ten bank notes per second results. In part, mouldings or apertures for the plugging into pins 2.1., 2.2, . . . (for example, shown in FIGS. 1–3) are visible. Also visible in part are pegs 55.1, 55.2, . . . , which engage (visible in FIG. 1) perforated wheels, resp., wheel rims 53.1, 53.2, . . . and in this manner transmit torques from the plate 1 into the modules 31–36. Driven by these means of transmission are transport shafts 551.1, 551.2, . . . and finally transport rollers 552.1, 552.2, . . . which, by means of adhesive friction, effect the transportation of the bank notes 100.

Figure 7:
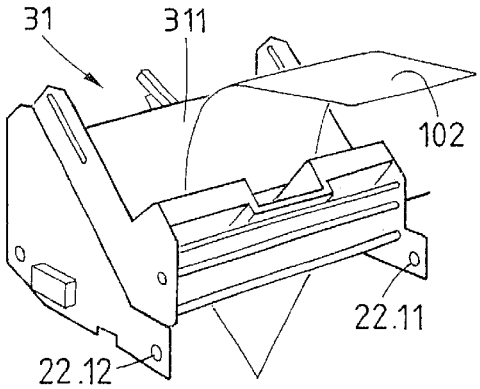
Figure 10:
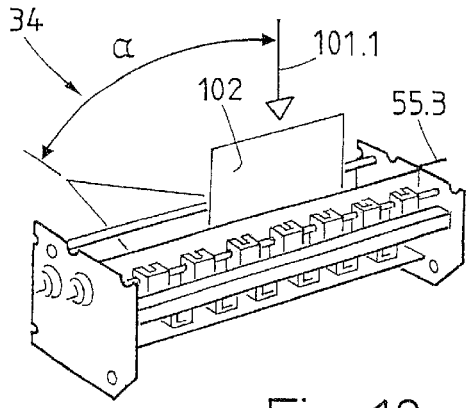
Figure 8:
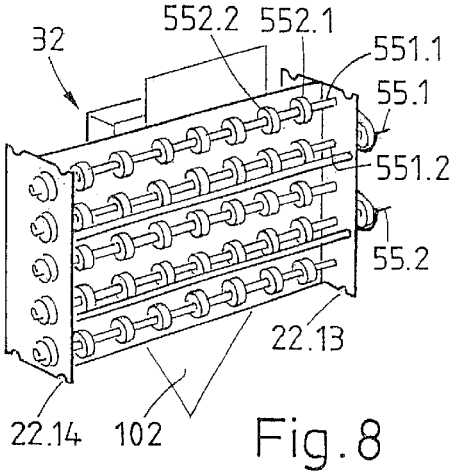
Figure 11:
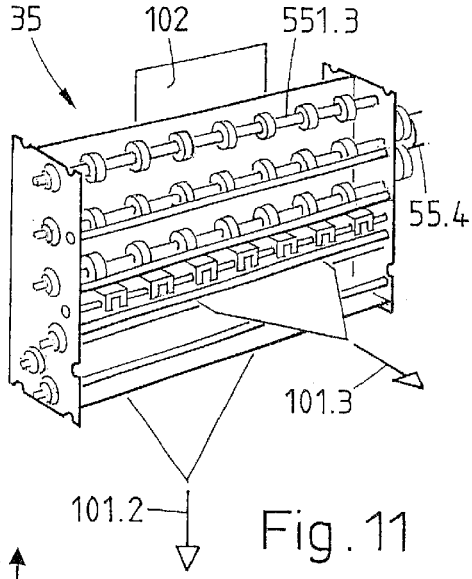
Figure 9:
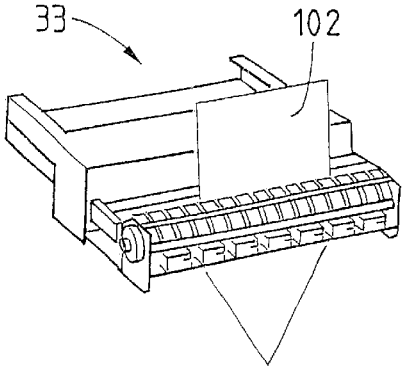
Figure 12:
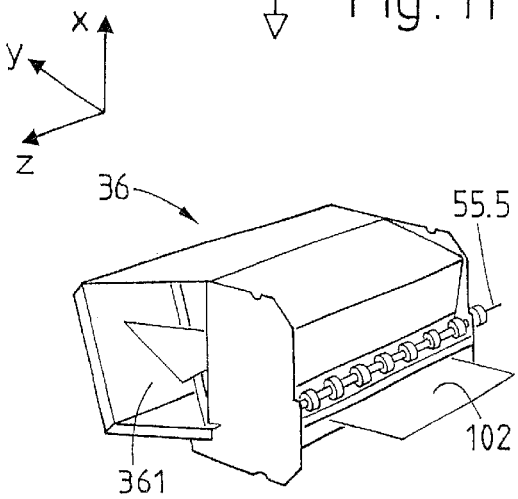

In FIG. 7, a module 31 for the insertion and separation of bank notes 100 is illustrated. The bank notes 100 are placed in an inlet compartment 311 as a stack, individually drawn in by the module 31 and therefore separated from the stack and from one another. FIG. 8 shows a transport module 32 for the linear transportation of the bank notes 100. By the module 33 of FIG. 9, the bank notes 100 are optically read, for example, with the help of (not visible in FIG. 9) CCD arrays and/or CCD matrices. FIG. 10 illustrates a deflection module 34, which deflects the bank notes 100 by a certain angle α, for example, by α=90°, relative to their original direction of movement 101.1. The module 35 of FIG. 11 is a branching module, a sorting module or a switch point. Depending on the position of a switch 42 (depicted in FIG. 1), the movements of which are transmitted with the help of (indicated in FIG. 1) means of transmission 56 into the module 35, the module 35 transfers a bank note 100 onwards in a first direction 101.2, for example, undeflected, or in a second direction 101.3, for example, deflected by 90°. Finally, in FIG. 12 a stacking module 36 is shown. The bank notes 100 are stacked in an outlet compartment 361 and can then be removed from this outlet compartment 361.

It is naturally contemplated that other modules, which are not described here, can be inserted into the device in accordance with the invention. Also the connection between modules and the fixed part can be implemented with other means.

In the FIGS. 13–19, some details of certain modules of the device in accordance with the invention are dealt with.

Figure 13:
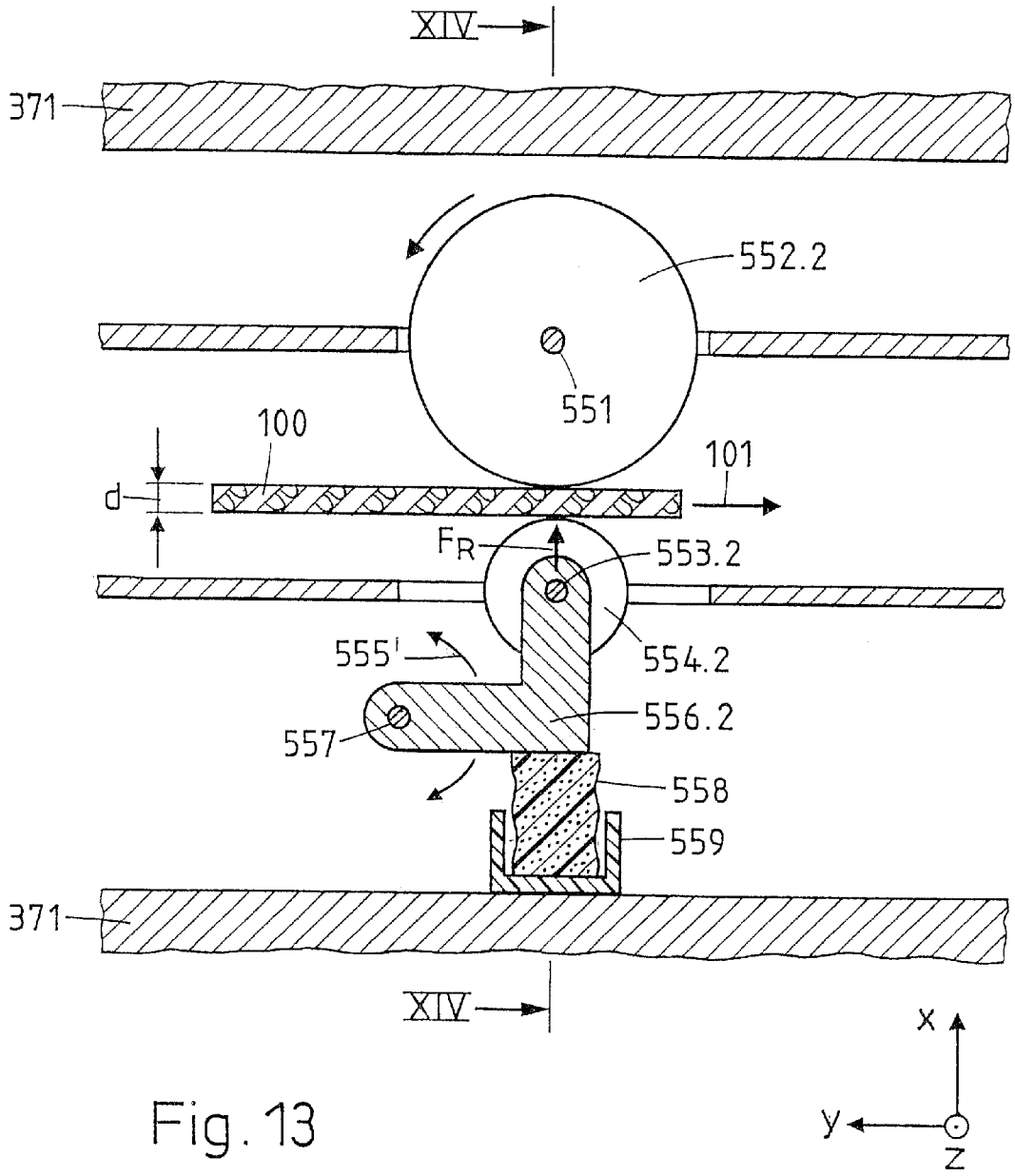
Figure 14:
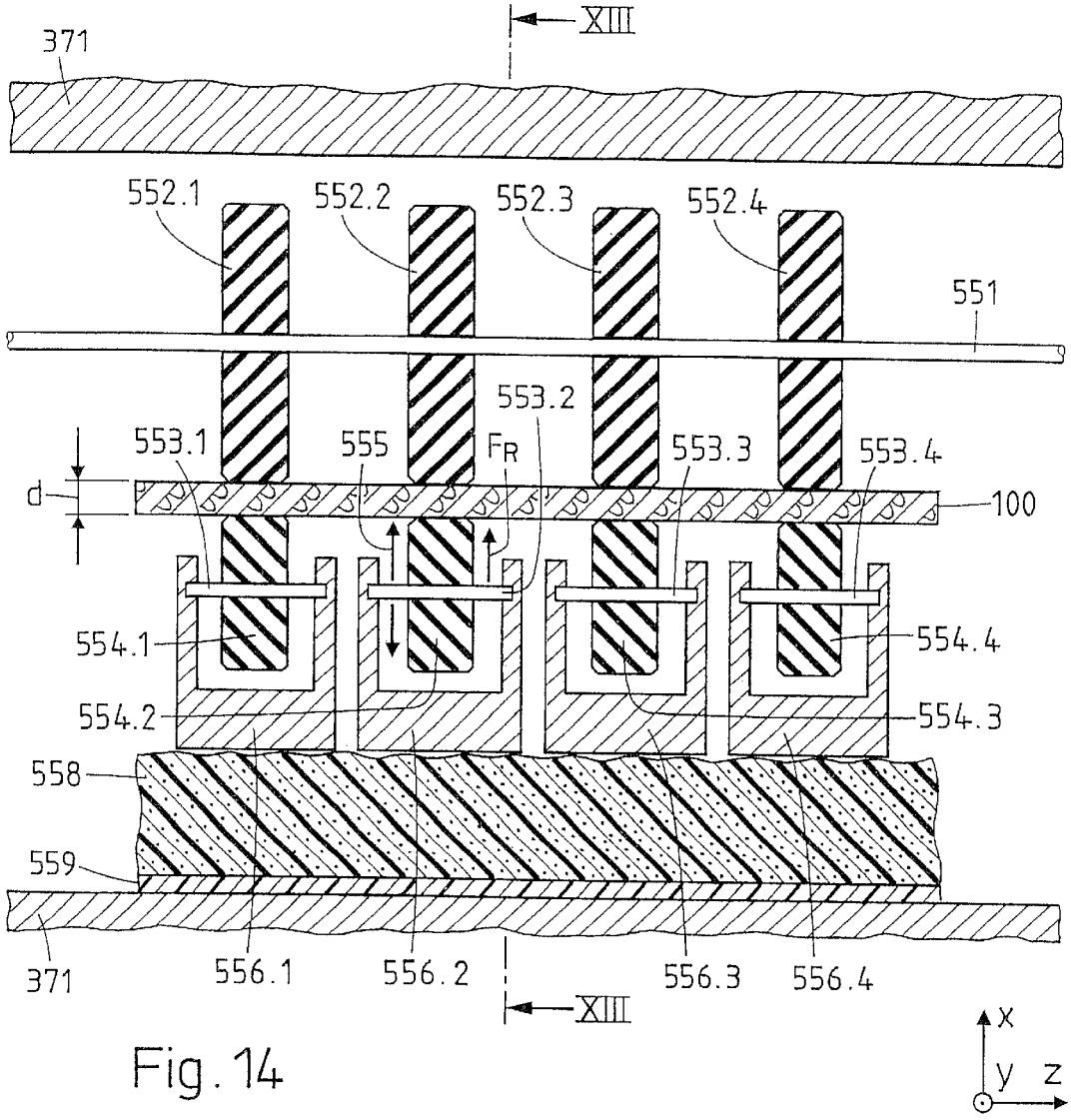

FIGS. 13 and 14 illustrate a transport unit for the transportation of the bank note-like objects 100 within a module. It contains a (not indicated in FIGS. 13, 14) transport shaft 551 driven by drive means 41 and possibly present means of transmission 51–55 with preferably several transport rollers 552.1–552.4, which act on the bank note-like objects 100 and effect their transportation through the transport unit. The transport rollers 552.1–552.4, resp., their active surfaces, consist of a material that has a high adhesive friction coefficient versus the bank note-like objects 100, for example, an elastomer. In order for an adhesive friction force on the bank note-like objects 100 in the direction of transport 101 to be able to become effective, the bank note-like objects 100 are, by means of several pressure rollers 554.1–554.2 acting in conjunction with the transport rollers 552.1–552.4 on preferably (not driven) pressure shafts 553.1–553.4, pressed against the transport rollers 552.1–552.4. The gap between the transport rollers 552.1–552.4 and pressure rollers 554.1–554.4 has to be variable by at least the thickness d of the bank note-like objects 100. For this purpose, the pressure rollers 554.1–554.3 are suspended individually and movable perpendicular to the direction of transport 101 and relative to the pressure shafts 553.1–553.4. The direction of movement of the pressure rollers 554.1–554.3 is indicated by a double arrow 555. Such movable suspensions can be approximated by small rotations 555' of the pressure shafts 553.1–553.4 around a suspension axis 557 fixed in the device. The pressure shafts 553.1–553.4 can be rotatably supported, for example, in suspension elements 556.1–556.4, which are hooked onto the suspension axis 557. In a particularly advantageous embodiment illustrated in FIG. 19, the pressure shafts 553.1–553.4 can also be manufactured as a single part together with the pressure rollers 554.1–554.4 and made, for example, from a plastic material.

On the pressure rollers 554.1–554.4, the pressure shafts 553.1–553.4, resp., the suspension elements 556.1–556.4, in the direction of the transport rollers 552.1–552.4 retro-acting or biasing forces $F_R$ should be exerted. Usually in the case of known devices the retro-acting forces $F_R$ are exerted with several helical springs. Such an arrangement, however, is complicated, expensive and susceptible to malfunction. In the device in accordance with the invention, the retro-acting forces $F_R$ are produced by a reversibly compressible foam material element 558. The foam material element 558 is in preference at least as long (in the z-direction) as the total length of all rollers 552.1–552.4, resp., 554.1–554.4. The foam material element 558 is held in a holder 559 and supported versus a module housing 371. This pressure unit in accordance with the invention has the advantages of being simple, cheap and not susceptible to malfunction. A single foam material element 558 is sufficient to exert retro-acting force $F_R$ on every pressure roller 554.1–554.4 individually. Apart from this, the foam material element 558 not only supplies the retro-acting forces $F_R$, but also desirable damping, so that the pressure rollers 554.1–554.4 maintain the desired, variable working gap to the transport rollers 552.1–552.4 without vibrating.

Such a pressure unit with at least one foam material element can of course be utilized not only in a transport unit, but also in other units. Thus, the pressure rollers 554.1–554.4 can also push the bank note-like objects 100 against other elements, such as, for example, a reading window of a reading module 33.

At certain points of the device, position sensors are required in order to determine whether a bank note-like object is present at a certain point at a certain time. Known devices utilize optical light barriers for this purpose. The disadvantage of such light barriers is that they are mounted close to the passage of the bank note-like objects and, as a result, are quickly contaminated with dirt, which impairs their operability. The invention solves this problem, in that the presence of a bank note-like object is mechanically detected. Optical sensors are located at a distance from the passage of the bank note-like objects or screened, in preference even attached outside a module.

Figure 15:
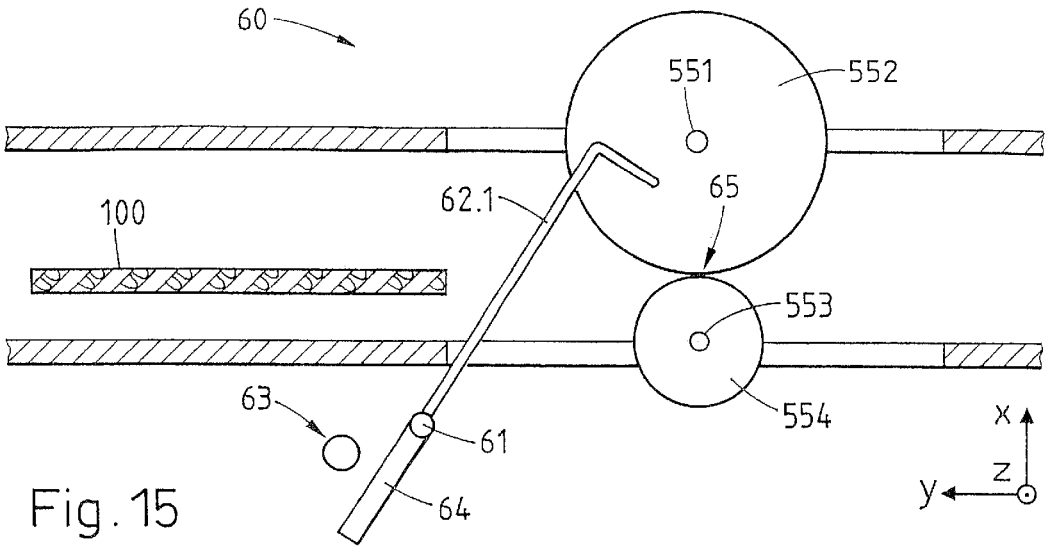
Figure 16:
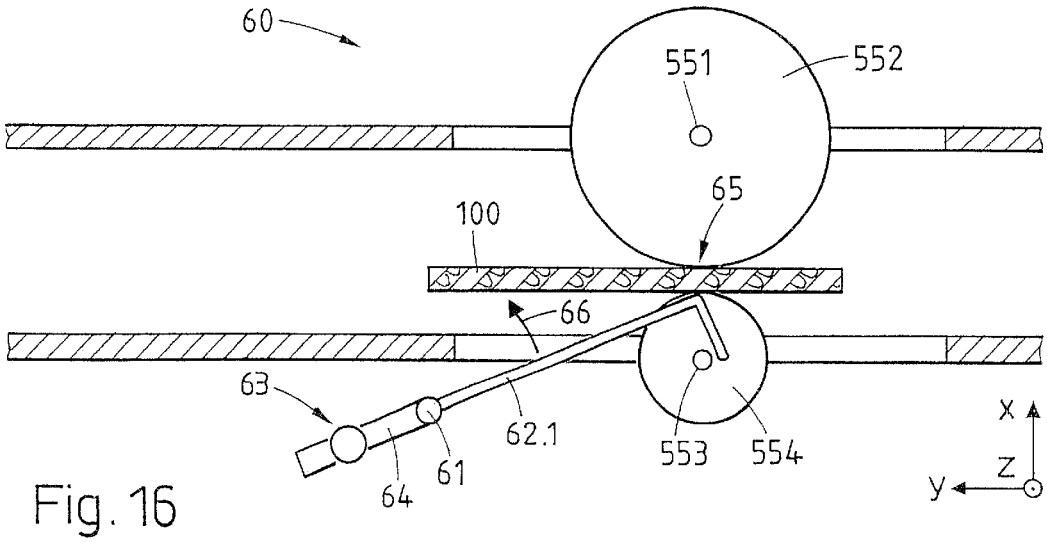
Figure 17:
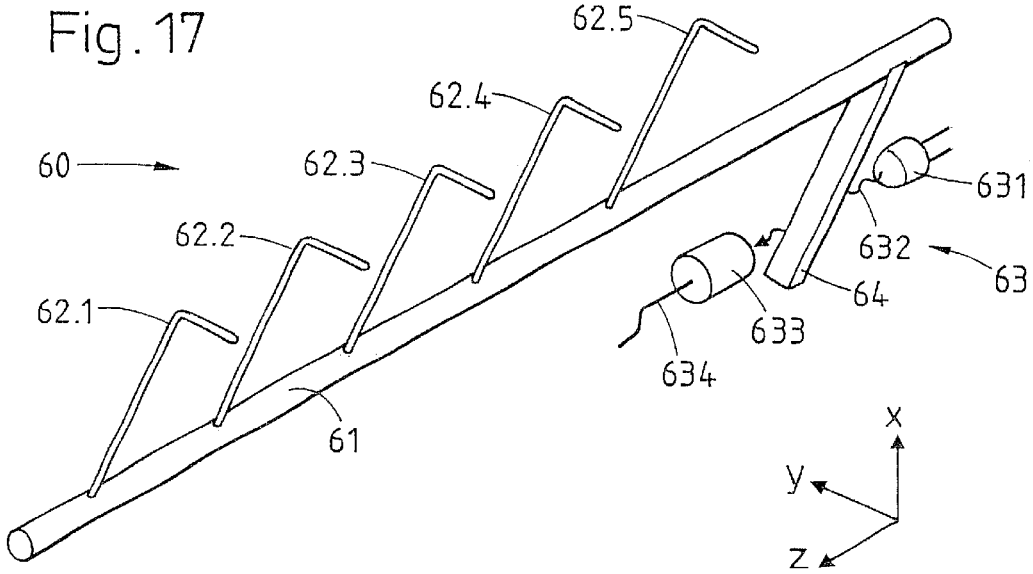
Figure 18:
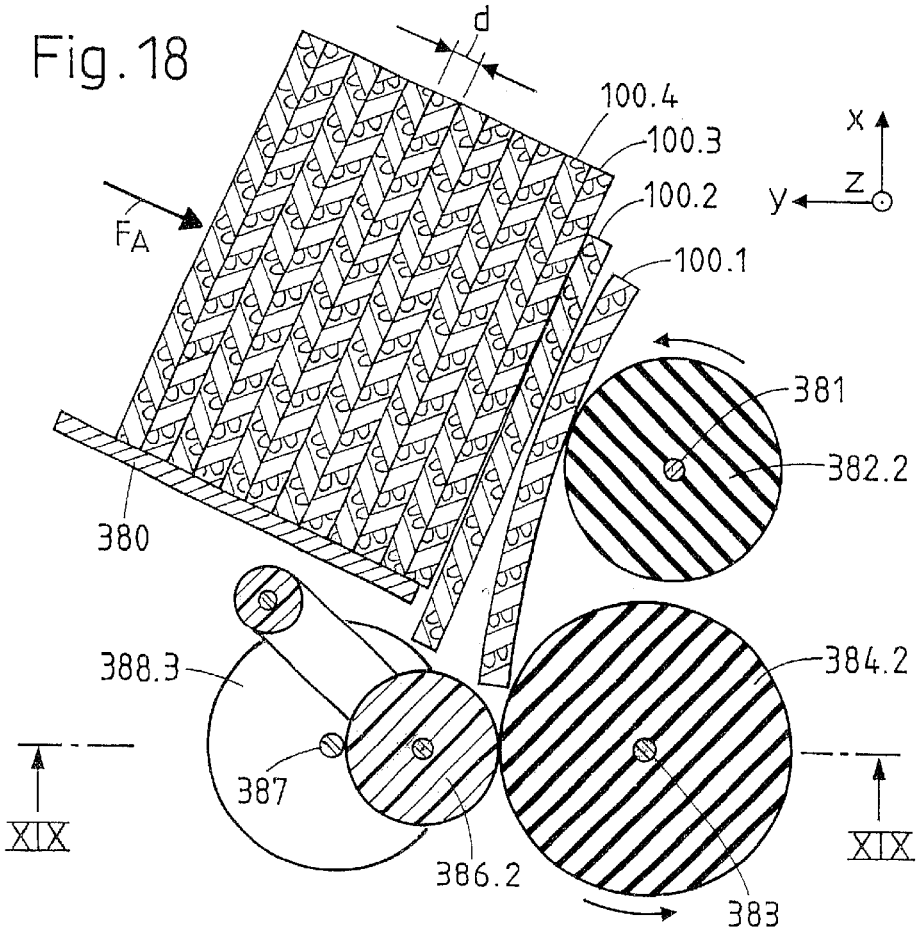
Figure 19:
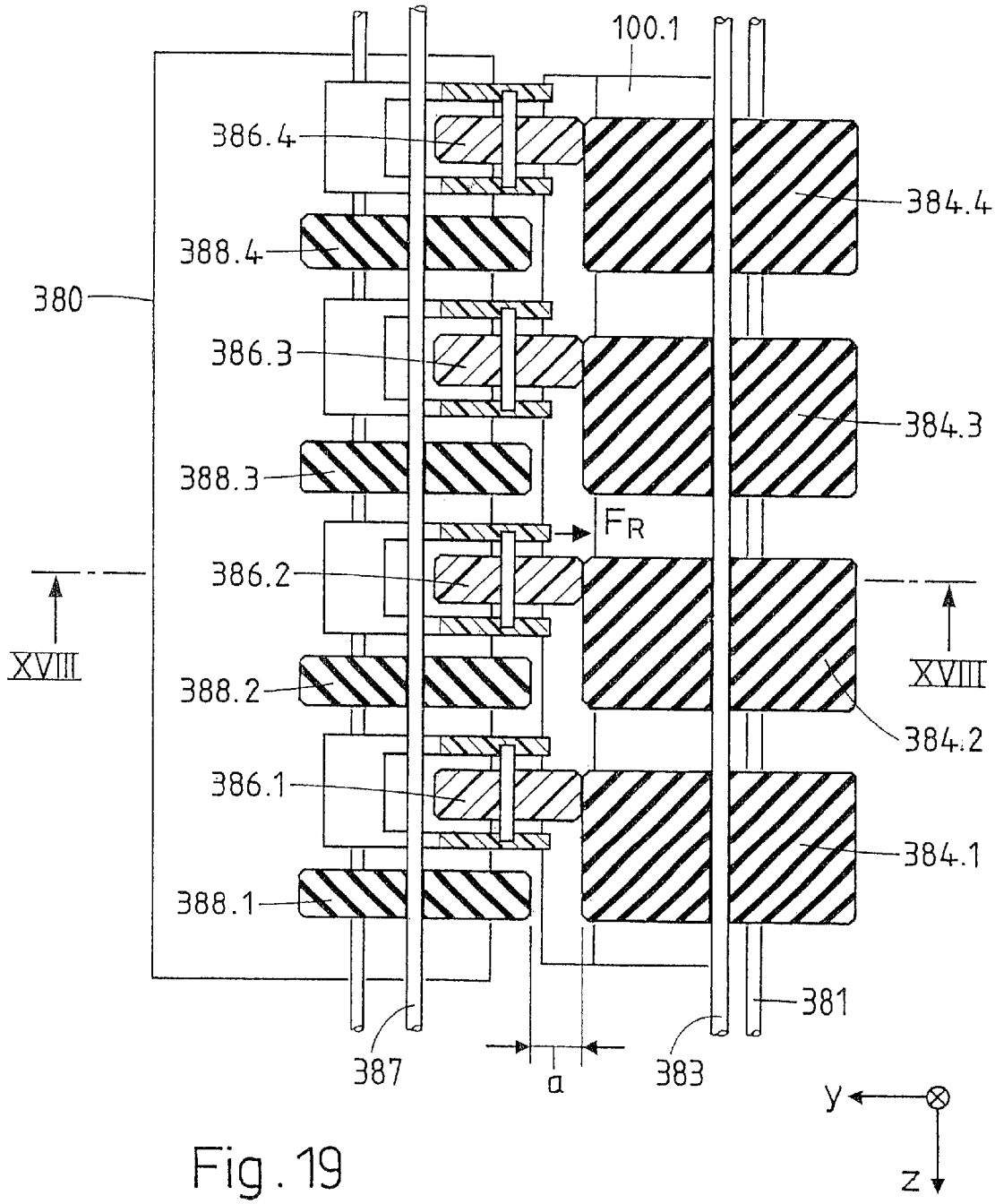

An embodiment of such a position sensor 60 of the device in accordance with the invention is depicted in the FIGS. 15 and 16 in longitudinal section, similar to the depiction of FIG. 14, and in FIG. 17 in a perspective view. The position sensor 60 contains mechanical detection elements 62.1–62.5, and at least one proximity element 64 connected with the detecting elements 62.1–52.5. The detecting elements 62.1–62.5 and the proximity element 64 in this exemplary embodiment are located on a detecting shaft 61, rigidly connected with it and rotatable. The detecting elements 62.1–62.5, for example, have the shape of sensing fingers bent towards their ends. Apart from this, the position sensor 60 contains a measuring element 63, which acts in conjunction with the proximity element 64 and transmits an electric output signal dependent on the position of the proximity element 64 to an electric line 634. In doing this, the measuring element 63, e.g., as in the FIGS. 15–17, can be a light barrier with a light source 631, a photo-detector 633 and a light path 632 between them. The light path 632 is interruptible by the proximity element 64. The measuring element 63, however, can also be implemented as a proximity switch, etc. Important is the fact that the measuring element 63 is located at a distance from the passage of the bank note-like objects 100 or else screened and inaccessible to contamination with dirt. In the present invention this is achieved by locating the measuring element 63 on the first side 11 of the plate 1 (refer to FIG. 1), for example, on a printed circuit board 82.1–82.3. The proximity element 64 therefore transmits a mechanical signal from the respective module to the plate 1 and only on the plate 1 is the mechanical signal converted into an electric one. Contamination with dirt of the mechanical detecting elements 62.1–62.5 does not impair the function of the robust position sensor 60.

FIGS. 15 and 17 illustrate the position sensor 60 in a position of rest wherein no bank note-like object 100 is at the measuring point 65, i.e., in the zone of the rollers 552, 554. The measuring element 63 is in a first condition; in this example of an embodiment the light path 632 of the light barrier is not interrupted. FIG. 16 shows the position sensor 60 in a deflected position, in which a bank note-like object 100 is located at the measuring point 65. The measuring element 63 is in a second condition wherein the light path 632 of the light barrier is interrupted by the proximity element 64, and the output signal of the measuring element 63 is a different one from that in the first condition. In the deflected position, a retro-acting or biasing torque on the detecting elements 62.1–62.5, indicated with an arrow 66, is present. Therefore, as soon as the bank note-like object 100 is removed from the measuring point 65, the position sensor returns to the rest position shown in FIGS. 15 and 17.

A further aspect of the invention concerns a feeder—, resp., individualizing unit for the bank note-like objects 100.1, 100.2, . . . An embodiment of such a feeder unit, with which the inlet and separating module 31 is equipped, is illustrated in the FIGS. 18 and 19. Bank note-like objects, e.g., bank notes 100.3, 100.4, . . . lie on an inlet ramp 380 in form of a stack. By a pressure force $F_A$ the bank note-like objects 100.3, 100.4, . . . are pressed against feeder rollers located at the height of the bank notes, preferably several feeder rollers 382.1–382.4. The pressure force $F_A$ can be produced by a suitable mechanism or also by the force of gravity. The bank note in front 100.1 by means of feeder rollers 382.1–382.2 driven by the feeder shaft 381 by sliding or adhesive friction is accelerated in the direction of several transport rollers 384.1–384.4. The transport rollers 384.1–384.4 are driven by a transport shaft 383 and, similar as in the transport unit of the FIGS. 13 and 14, work in conjunction with pressure rollers 386.1–386.4. The pressure rollers 386.1–386.4 are movably suspended, and retro-acting or biasing forces $F_R$ in the direction of the transport rollers 384.1–384.4 act on them. The retro-acting forces $F_R$ are in preference produced by the mechanism in accordance with the invention described on the occasion of the FIGS. 13 and 14 (not illustrated here anymore).

In order to ensure that only a single bank note 100.1 and not several bank notes together are drawn in, the feeder unit in preference is equipped with several, in essence stationary, not rotating retaining rollers 388.1–388.4. The retaining rollers 388.1–388.4 are located on a retaining shaft 387 and are sporadically or continually, but very slowly (compared with the rotation speed of the transport rollers 384.1–384.4) rotated, in order to prevent a non-uniform wear of their surface. The retaining rollers 388.1–388.4 usually by sliding or adhesive friction, prevent more than a first bank note 100.1, i.e., a second (and further) bank note 100.2, from being drawn in. In the known feeder units, the retaining rollers and the transport rollers are offset relative to one another, and only the pressure rollers lie opposite the transport rollers (such as in FIG. 14). This leads to the fact, that a drawn-in bank note is undulated or deformed in the z-direction, which represents a considerable disadvantage for the subsequent processing functions, such as transportation or reading. Apart from this, it happens from time to time, that undesirably several bank notes are drawn in at the same time.

The feeder unit in accordance with the invention avoids these disadvantages, in that every retaining roller 388.1–388.4 lies opposite a transport roller 384.1–384.4. In this, the gap a between the retaining rollers 388.1–388.4 and the transport rollers 384.1–384.4 has to be adjusted fairly accurately to the bank note thickness d, i.e., in any case it must be applicable, that:

$$d \leq a < 2d.$$

This requirement for enhanced precision at first sight would appear to be disadvantageous in comparison with the prior art. However, one the foregoing equation one acquires two essential advantages: first of all no waviness of the drawn-in bank notes, and secondly a guaranteed individualization of the bank notes when drawn in.

In the example of an embodiment illustrated here, one pressure roller 386.1 and one retaining roller 388.1 are respectively located opposite a transport roller 384.1. It would also be possible that, for example, a pressure roller would be alternately located opposite a first transport roller and subsequently a retaining roller would be located opposite a second transport roller. It goes without saying, that in accordance with the invention also more than four feeder, transport, pressure, and/or retaining rollers can be present.

What an embodiment of the device in accordance with the invention could look like from outside, is illustrated in FIG. 20. The device is enclosed by a housing 9. Visible from outside are the inlet compartment 311 and, for example, two outlet compartments 361.1, 361.2. For communication with a user, an operating unit 90 can be foreseen. The operating unit 90 can contain an output unit, for example, a monitor screen or an LCD display, and/or an input unit, for example, a keyboard. In the example of an embodiment presented here, input and output unit are combined and implemented as a touch-sensitive screen 91 (touch-screen).

What is claimed is:

1. A contact pressure unit for installation in a device for processing bank-note like objects, said pressure unit comprising: at least one contact element, at least one reversibly compressible and damping element, and at least one movably suspended pressure roller for pressing a bank-note like object against the at least one contact element in response to retro-acting forces acting on the at least one pressure roller in the direction of the at least one contact element, wherein the retro-acting forces are continuously produced by the at least one reversibly compressible and damping element to urge the at least one suspended pressure roller toward the at least one contact element.

2. The contact pressure unit of claim 1, wherein the at least one reversibly compressible and damping element comprises a rubber foam element.

3. The contact pressure unit of claim 1, wherein the at least one pressure roller comprises a plurality of pressure rollers, and wherein the contact pressure unit further comprises pressure shafts upon which the pressure rollers are supported.

4. The contact pressure unit of claim 3, wherein the pressure shafts are not driven.

5. The contact pressure unit of claim 3, wherein the pressure rollers are individually movable in a direction perpendicular to the pressure shafts.

6. The contact pressure unit of claim 3, wherein the pressure shafts have been manufactured as a single piece together with the pressure rollers.

7. The contact pressure unit of claim 3, wherein the contact pressure unit further comprises suspension elements and a suspension axis, said suspension elements rotatably supporting the pressure shafts and being connected to the suspension axis.

8. The contact pressure unit of claim 3, wherein the at least one reversibly compressible and damping element comprises a single rubber foam element having a length that is at least as long as the total length of the pressure rollers, said rubber foam element being arranged relative to the pressure rollers such that the rubber foam element exerts retro-acting forces on all of the pressure rollers.

9. The contact pressure unit of claim 1, wherein the contact pressure unit is a transport unit for transporting bank note-like objects and wherein the at least one contact element comprises at least one drivable transport roller.

10. The contact pressure unit of claim 9, wherein the at least one drivable transport roller comprises a plurality of drivable transport rollers.

11. A device for processing bank-note like objects comprising the contact pressure unit of claim 1.

12. The contact pressure unit of claim 1, wherein the at least one reversibly compressible and damping element is always at least partially compressed, thus continuously producing retro-acting forces.

13. The contact pressure unit of claim 1, wherein an end of the at least one reversibly compressible and damping element opposite the pressure roller is restricted from movement away from the at least one contact element by a module housing.

* * * * *